US009489963B2

(12) United States Patent
Jazi et al.

(10) Patent No.: US 9,489,963 B2
(45) Date of Patent: Nov. 8, 2016

(54) CORRELATION-BASED TWO MICROPHONE ALGORITHM FOR NOISE REDUCTION IN REVERBERATION

(71) Applicant: QUALCOMM Technologies International, Ltd., Cambridge (GB)

(72) Inventors: Nima Yousefian Jazi, Rochester Hills, MI (US); Rogerio Guedes Alves, Macomb Township, MI (US)

(73) Assignee: QUALCOMM TECHNOLOGIES INTERNATIONAL, LTD., Cambridge (GB)

( * ) Notice: Subject to any disclaimer, the term of this patent is extended or adjusted under 35 U.S.C. 154(b) by 0 days.

(21) Appl. No.: 14/658,873

(22) Filed: Mar. 16, 2015

(65) Prior Publication Data

US 2016/0275966 A1 Sep. 22, 2016

(51) Int. Cl.
*G10L 21/0208* (2013.01)
*G10L 21/0316* (2013.01)
*G10L 21/0216* (2013.01)

(52) U.S. Cl.
CPC ..... *G10L 21/0208* (2013.01); *G10L 21/0316* (2013.01); *G10L 2021/02165* (2013.01)

(58) Field of Classification Search
CPC ..... G10L 21/0208; G10L 2021/02082; G10L 2021/02085; G10L 2021/02165; G10L 2021/02166
See application file for complete search history.

(56) References Cited

U.S. PATENT DOCUMENTS

2002/0002455 A1* 1/2002 Accardi ..... G10L 21/0208 704/226
2007/0033029 A1* 2/2007 Sakawaki ..... G10K 11/178 704/233
2011/0038489 A1* 2/2011 Visser ..... G01S 3/8006 381/92
2012/0020496 A1* 1/2012 Hetherington ..... H04M 9/082 381/98
2012/0051548 A1* 3/2012 Visser ..... G10L 21/0208 381/56
2014/0193009 A1* 7/2014 Yousefian Jazi .... G10L 21/0208 381/317
2015/0294674 A1* 10/2015 Takahashi ..... G10L 25/78 704/226
2015/0304766 A1* 10/2015 Delikaris-Manias ..... G10L 21/0216 381/92
2016/0019906 A1* 1/2016 Takahashi ..... G10L 21/0208 704/228

OTHER PUBLICATIONS

J. Allen, D. Berkley and J. Blauert, "Multimicrophone signal-processing technique to remove room reverberation from speech signals," The Journal of the Acoustical Society of America, vol. 62, No. 4, pp. 912-915, 1977.

(Continued)

*Primary Examiner* — Douglas Godbold
(74) *Attorney, Agent, or Firm* — Procopio, Cory, Hargreaves & Savitch LLP

(57) ABSTRACT

Embodiments are directed towards providing speech enhancement of audio signals from a target source and noise reduction of audio signals from a noise source. A coherence between a first audio signal from a first microphone and a second audio signal from a second microphone may be determined. A first gain function may be determined based on real components of a coherence function, wherein the real components include coefficients based on the previously determined coherence. A second gain function may be determined based on imaginary components of the coherence function. And a third gain function may be determined based on a relationship between a real component of the coherence function and a threshold range. An enhanced audio signal may be generated by applying a combination of the first gain function, the second gain function, and the third gain function to the first audio signal.

20 Claims, 9 Drawing Sheets

(56) References Cited

OTHER PUBLICATIONS

L. Bouquin-Jeannes, A A Azirani and G. Faucon. "Enhancement of speech degraded by coherent and incoherent noise using a cross-spectral estimator," Speech and Audio Processing, IEEE Transactions on, vol. 5, No. 5, pp. 484-487, 1997.
N. Yousefian and P C. Loizou, "A dual-microphone algorithm that can cope with competingtalker scenarios," Audio, Speech, and Language Processing, IEEE Transactions on, vol. 21, No. 1, pp. 145-155, 2013.
J. Benesty, J. Chen and Y. Huang, "Estimation of the coherence function with the MVDR approach," in IEEE International Cofnerence on Acoustics, Speech and Signal Processing (ICASSP), Toulouse, France, 2006.
M. Jeub, C. Nelke, B. Christophe and P. Vary, "Blind estimation of the coherence-to-diffuse energy ratio from noisy speech signals," in 19th European Signal Processing Conference, 2011.
N. Yousefian and P C. Loizou, "A dual-microphone speech enhancement algorithm based on the coherence function," Audio, Speech, and Language Processing, IEEE Transactions on, vol. 20, No. 2, pp. 599-609, 2012.
ITU-T, "862: Perceptual evaluation of speech quality (PESQ): An objective method for end-to-end speech quality assessment of narrow-band telephone networks and speech codecs," Series P: Telephone Transmission Quality, Telephone Installiations, Lcoal Line Networks Method for Objective and Subjective Assessment of Quality, 2001, (30 pages).
Y. Hu and P. C Loizou, "Evaluation of objective quality measures for speech enhancement," Audio, Speecl7, and Language Processing, IEEE Transactions on, vol. 16, No. 1, pp. 229-238, 2008.
ITU-T, "G.111: Loudness ratings (LRs) in an international connection," Transmission Systems and Media General Recommendations on the Transmission Quality for an Entire International Telephone Connection. 1993. (21 pages).
J Ming, T. J. Hazen, J. R. Glass and D. A. Reynolds, "Robust speaker recognition in noisy conditions," Audio, Speech, and Language Processing, IEEE Transactions on, vol. 15, No. 5, pp. 1711-1723, 2007.
A. Fazel and S. Chakrabartty, "An overview of statistical pattern recognition techniques for speaker verification," Circuits and Systems Magazine, IEEE, vol. 11, No. 2, pp. 62-81, 2011.
I. A. Mocowan and H. Bourlard, "Microphone array post-filter based on noise field coherence," Speech and Audio Processing, IEEE Transactions on, vol. 11, No. 6, pp. 709-816, 2003.
H. Kuttruff, Room Acoustics, Chapter 8 "Measuring techniques in room acoustics", Fifth Edition, 2009, pp. 251-293.
Yousefian Nima et al: "A coherence-based algorithm for noise reduction in dual-microphone applications", 2006 14th European Signal Processing Conference, IEEE, Aug. 23, 2010 (Aug. 23, 2010), pp. 1904-1908.
R Le Bouquin et al: "Using the coherence function for noise reduction", IEE Proceedings I Communications, Speech and Vision, Jan. 1, 1992 (Jan. 1, 1992), p. 276.
International Search Report and Written Opinion of the European Patent Office. Apr. 21, 2016. 10 pages.

* cited by examiner

CORRELATION-BASED TWO MICROPHONE ALGORITHM FOR NOISE REDUCTION IN REVERBERATION

TECHNICAL FIELD

The present invention relates generally to noise reduction and speech enhancement, and more particularly, but not exclusively, to employing a coherence function with multiple gain functions to reduce noise in an audio signal within a two microphone system.

BACKGROUND

Today, many people use "hands-free" telecommunication systems to talk with one another. These systems often utilize mobile phones, a remote loudspeaker, and a remote microphone to achieve hands-free operation, and may generally be referred to as speakerphones. Speakerphones can introduce—to a user—the freedom of having a phone call in different environments. In noisy environments, however, these systems may not operate at a level that is satisfactory to a user. For example, the variation in power of user speech in the speakerphone microphone may generate a different signal-to-noise ratio (SNR) depending on the environment and/or the distance between the user and the microphone. Low SNR can make it difficult to detect or distinguish the user speech signal from the noise signals. Moreover, the more reverberant the environment is, the more difficult it can be to reduce the noise signals. Thus, it is with respect to these considerations and others that the invention has been made.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Detailed Description, which is to be read in association with the accompanying drawings, wherein.

DETAILED DESCRIPTION

Various embodiments are described more fully hereinafter with reference to the accompanying drawings, which form a part hereof, and which show, by way of illustration, specific embodiments by which the invention may be practiced. The embodiments may, however, be embodied in many different forms and should not be construed as limited to the embodiments set forth herein; rather, these embodiments are provided so that this disclosure will be thorough and complete, and will fully convey the scope of the embodiments to those skilled in the art. Among other things, the various embodiments may be methods, systems, media, or devices. Accordingly, the various embodiments may be entirely hardware embodiments, entirely software embodiments, or embodiments combining software and hardware aspects. The following detailed description should, therefore, not be limiting.

Throughout the specification and claims, the following terms take the meanings explicitly associated herein, unless the context clearly dictates otherwise. The term "herein" refers to the specification, claims, and drawings associated with the current application. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

Figure 3:
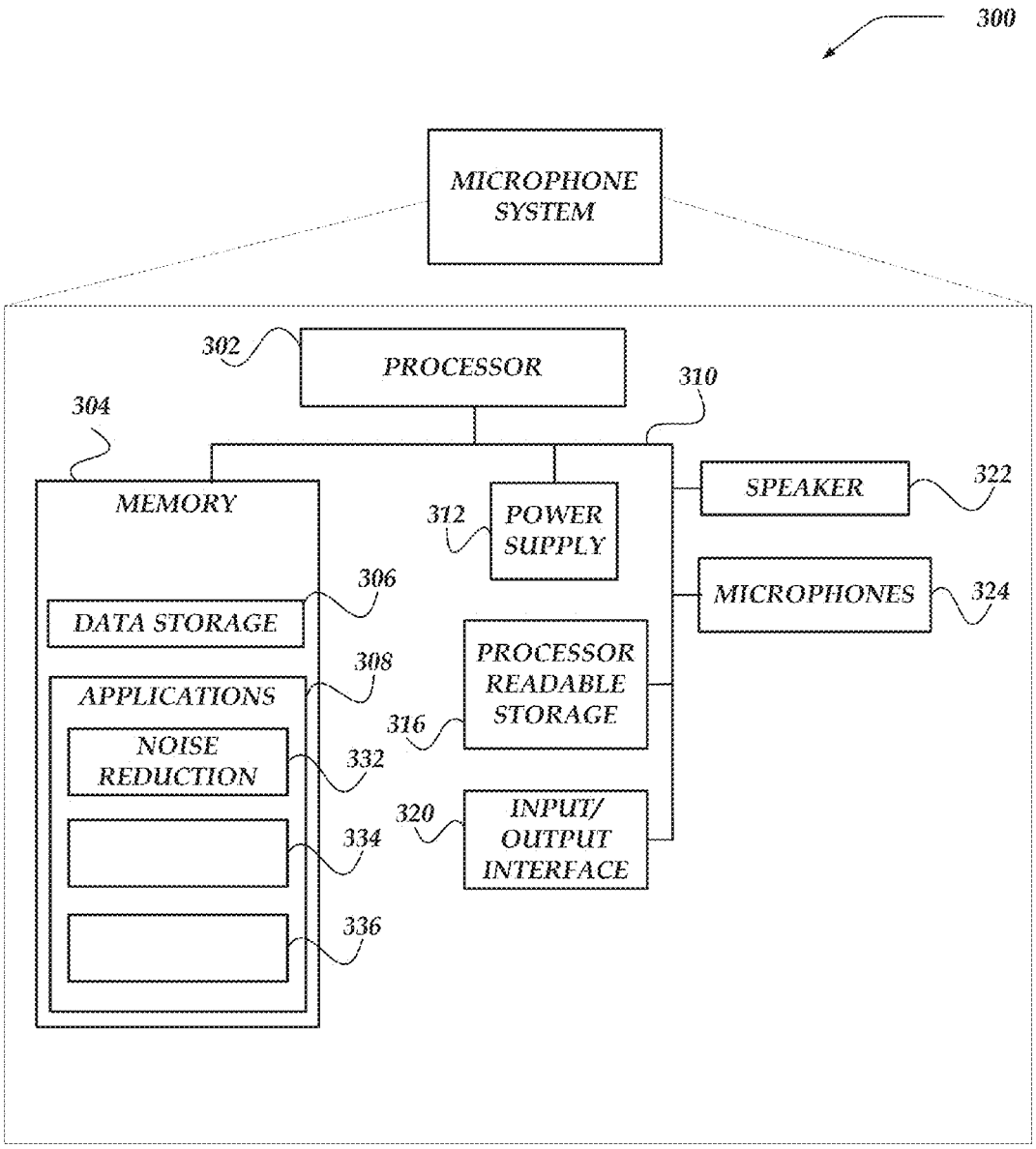
FIG. 3 shows an embodiment of a microphone system that may be included in a system such as that shown in FIG. 1

As used herein, the term "microphone system" refers to a system that includes a plurality of microphones for capturing audio signals. In some embodiments, the microphone system may be part of a "speaker/microphone system" that may be employed to enable "hands free" telecommunications. One example embodiment of a microphone system is illustrated in FIG. 3.

The following briefly describes embodiments of the invention in order to provide a basic understanding of some aspects of the invention. This brief description is not intended as an extensive overview. It is not intended to identify key or critical elements, or to delineate or otherwise narrow the scope. Its purpose is merely to present some concepts in a simplified form as a prelude to the more detailed description that is presented later.

Briefly stated, various embodiments are directed to providing speech enhancement of audio signals from a target source and noise reduction of audio signals from a noise source. A coherence between a first audio signal from a first microphone and a second audio signal from a second microphone may be determined. In various embodiments, the coherence function may be based on a weighted combination of coherent noise field and diffuse noise field characteristics. In at least one of the various embodiments, the coherence function utilizes an angle of incidence of the target source and another angle of incidence of the noise source.

A first gain function may be determined based on real components of a coherence function, wherein the real components include coefficients based on the previously determined coherence. In various embodiments, the coefficients are based on a direct-to-reverberant energy ratio that utilizes the coherence. A second gain function may be determined based on imaginary components of the coherence function. And a third gain function may be determined based on a relationship between a real component of the coherence function and a threshold range. In various embodiments, the third gain function may be a constant value for attenuating frequency components outside of the threshold range.

An enhanced audio signal may be generated by applying a combination of the first gain function, the second gain function, and the third gain function to the first audio signal. In various embodiments, the first gain function, the second gain function, and the third gain function may be determined independent of each other. In some embodiments, a constant may be employed to the combination of the first gain function, the second gain function, and the third gain function to set an aggressiveness of a final gain function to generate the enhanced audio signal.

Illustrative Operating Environment

Figure 1:
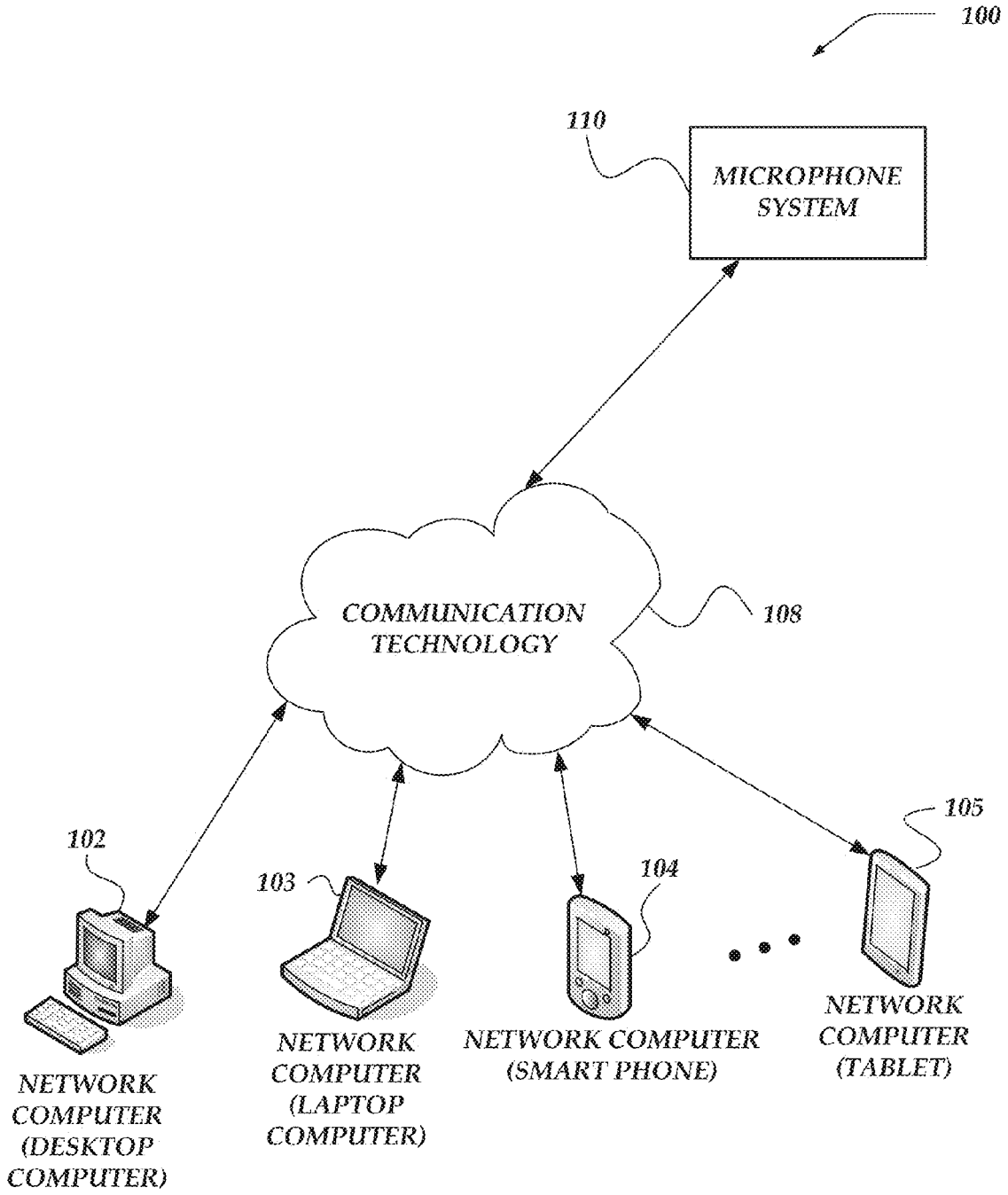
FIG. 1 is a system diagram of an environment in which embodiments of the invention may be implemented.

FIG. 1 shows components of one embodiment of an environment in which various embodiments of the invention may be practiced. Not all of the components may be required to practice the various embodiments, and variations in the arrangement and type of the components may be made without departing from the spirit or scope of the invention. As shown, system 100 of FIG. 1 may include microphone system 110, network computers 102-105, and communication technology 108.

At least one embodiment of network computers 102-105 is described in more detail below in conjunction with network computer 200 of FIG. 2. Briefly, in some embodiments, network computers 102-105 may be configured to communicate with microphone system 110 to enable telecommunication with other devices, such as hands-free telecommunication. Network computers 102-105 may perform a variety of noise reduction/cancelation mechanisms on signals received from microphone system 110, such as described herein.

In some embodiments, at least some of network computers 102-105 may operate over a wired and/or wireless network (e.g., communication technology 108) to communicate with other computing devices or microphone system 110. Generally, network computers 102-105 may include computing devices capable of communicating over a network to send and/or receive information, perform various online and/or offline activities, or the like. It should be recognized that embodiments described herein are not constrained by the number or type of network computers employed, and more or fewer network computers—and/or types of network computers—than what is illustrated in FIG. 1 may be employed.

Devices that may operate as network computers 102-105 may include various computing devices that typically connect to a network or other computing device using a wired and/or wireless communications medium. Network computers may include portable and/or non-portable computers. In some embodiments, network computers may include client computers, server computers, or the like. Examples of network computers 102-105 may include, but are not limited to, desktop computers (e.g., network computer 102), personal computers, multiprocessor systems, microprocessor-based or programmable electronic devices, network PCs, laptop computers (e.g., network computer 103), smart phones (e.g., network computer 104), tablet computers (e.g., network computer 105), cellular telephones, display pagers, radio frequency (RF) devices, infrared (IR) devices, Personal Digital Assistants (PDAs), handheld computers, wearable computing devices, entertainment/home media systems (e.g., televisions, gaming consoles, audio equipment, or the like), household devices (e.g., thermostats, refrigerators, home security systems, or the like), multimedia navigation systems, automotive communications and entertainment systems, integrated devices combining functionality of one or more of the preceding devices, or the like. As such, network computers 102-105 may include computers with a wide range of capabilities and features.

Network computers 102-105 may access and/or employ various computing applications to enable users of computers to perform various online and/or offline activities. Such activities may include, but are not limited to, generating documents, gathering/monitoring data, capturing/manipulating images, managing media, managing financial information, playing games, managing personal information, browsing the Internet, or the like. In some embodiments, network computers 102-105 may be enabled to connect to a network through a browser, or other web-based application.

Network computers 102-105 may further be configured to provide information that identifies the network computer. Such identifying information may include, but is not limited to, a type, capability, configuration, name, or the like, of the computer. In at least one embodiment, a network computer may uniquely identify itself through any of a variety of mechanisms, such as an Internet Protocol (IP) address, phone number, Mobile Identification Number (MIN), media access control (MAC) address, electronic serial number (ESN), or other device identifier.

At least one embodiment of microphone system 110 is described in more detail below in conjunction with microphone system 300 of FIG. 3. Briefly, in some embodiments, microphone system 110 may be configured to obtain audio signals and provide noise reduction/cancelation to generate an enhanced audio signal of targeted speech, as described herein. In various embodiments, microphone system 110 may part of a speaker/microphone system.

In some embodiments, microphone system 300 may communicate with one or more of network computers 102-105 to provide remote, hands-free telecommunication with others, while enabling noise reduction/cancelation. In other embodiments, microphone system 300 may be incorporated in or otherwise built into a network computer. In yet other embodiments, microphone system 300 may be a standalone device that may or may not communicate with a network computer. Examples of microphone system 110 may include, but are not limited to, Bluetooth soundbar or speaker with phone call support, karaoke machines with internal microphone, home theater systems, mobile phones, telephones, tablets, voice recorders, or the like.

In various embodiments, network computers 102-105 may communicate with microphone system 110 via communication technology 108. In various embodiments, communication technology 108 may be a wired technology, such as, but not limited to, a cable with a jack for connecting to an audio input/output port on network computers 102-105 (such a jack may include, but is not limited to a typical headphone jack, a USB connection, or other suitable computer connector). In other embodiments, communication technology 108 may be a wireless communication technology, which may include virtually any wireless technology for communicating with a remote device, such as, but not limited to, Bluetooth, Wi-Fi, or the like.

In some embodiments, communication technology 108 may be a network configured to couple network computers with other computing devices, including network computers 102-105, microphone system 110, or the like. In various embodiments, information communicated between devices may include various kinds of information, including, but not limited to, processor-readable instructions, remote requests, server responses, program modules, applications, raw data, control data, system information (e.g., log files), video data, voice data, image data, text data, structured/unstructured data, or the like. In some embodiments, this information may be communicated between devices using one or more technologies and/or network protocols.

In some embodiments, such a network may include various wired networks, wireless networks, or any combination thereof. In various embodiments, the network may be enabled to employ various forms of communication technology, topology, computer-readable media, or the like, for communicating information from one electronic device to another. For example, the network can include—in addition to the Internet—LANs, WANs, Personal Area Networks (PANs), Campus Area Networks (CANs), Metropolitan Area Networks (MANs), direct communication connections (such as through a universal serial bus (USB) port), or the like, or any combination thereof.

In various embodiments, communication links within and/or between networks may include, but are not limited to, twisted wire pair, optical fibers, open air lasers, coaxial cable, plain old telephone service (POTS), wave guides, acoustics, full or fractional dedicated digital lines (such as T1, T2, T3, or T4), E-carriers, Integrated Services Digital Networks (ISDNs), Digital Subscriber Lines (DSLs), wireless links (including satellite links), or other links and/or carrier mechanisms known to those skilled in the art. Moreover, communication links may further employ any of a variety of digital signaling technologies, including without limit, for example, DS-0, DS-1, DS-2, DS-3, DS-4, OC-3, OC-12, OC-48, or the like. In some embodiments, a router (or other intermediate network device) may act as a link between various networks—including those based on different architectures and/or protocols—to enable information to be transferred from one network to another. In other embodiments, network computers and/or other related electronic devices could be connected to a network via a modem and temporary telephone link. In essence, the network may include any communication technology by which information may travel between computing devices.

The network may, in some embodiments, include various wireless networks, which may be configured to couple various portable network devices, remote computers, wired networks, other wireless networks, or the like. Wireless networks may include any of a variety of sub-networks that may further overlay stand-alone ad-hoc networks, or the like, to provide an infrastructure-oriented connection for at least network computers 103-105. Such sub-networks may include mesh networks, Wireless LAN (WLAN) networks, cellular networks, or the like. In at least one of the various embodiments, the system may include more than one wireless network.

The network may employ a plurality of wired and/or wireless communication protocols and/or technologies. Examples of various generations (e.g., third (3G), fourth (4G), or fifth (5G)) of communication protocols and/or technologies that may be employed by the network may include, but are not limited to, Global System for Mobile communication (GSM), General Packet Radio Services (GPRS), Enhanced Data GSM Environment (EDGE), Code Division Multiple Access (CDMA), Wideband Code Division Multiple Access (W-CDMA), Code Division Multiple Access 2000 (CDMA2000), High Speed Downlink Packet Access (HSDPA), Long Term Evolution (LTE), Universal Mobile Telecommunications System (UMTS), Evolution-Data Optimized (Ev-DO), Worldwide Interoperability for Microwave Access (WiMax), time division multiple access (TDMA), Orthogonal frequency-division multiplexing (OFDM), ultra wide band (UWB), Wireless Application Protocol (WAP), user datagram protocol (UDP), transmission control protocol/Internet protocol (TCP/IP), any portion of the Open Systems Interconnection (OSI) model protocols, session initiated protocol/real-time transport protocol (SIP/RTP), short message service (SMS), multimedia messaging service (MMS), or any of a variety of other communication protocols and/or technologies. In essence, the network may include communication technologies by which information may travel between network computers 102-105, microphone system 110, other computing devices not illustrated, other networks, or the like.

In various embodiments, at least a portion of the network may be arranged as an autonomous system of nodes, links, paths, terminals, gateways, routers, switches, firewalls, load balancers, forwarders, repeaters, optical-electrical converters, or the like, which may be connected by various communication links. These autonomous systems may be configured to self organize based on current operating conditions and/or rule-based policies, such that the network topology of the network may be modified.

Illustrative Network Computer

Figure 2:
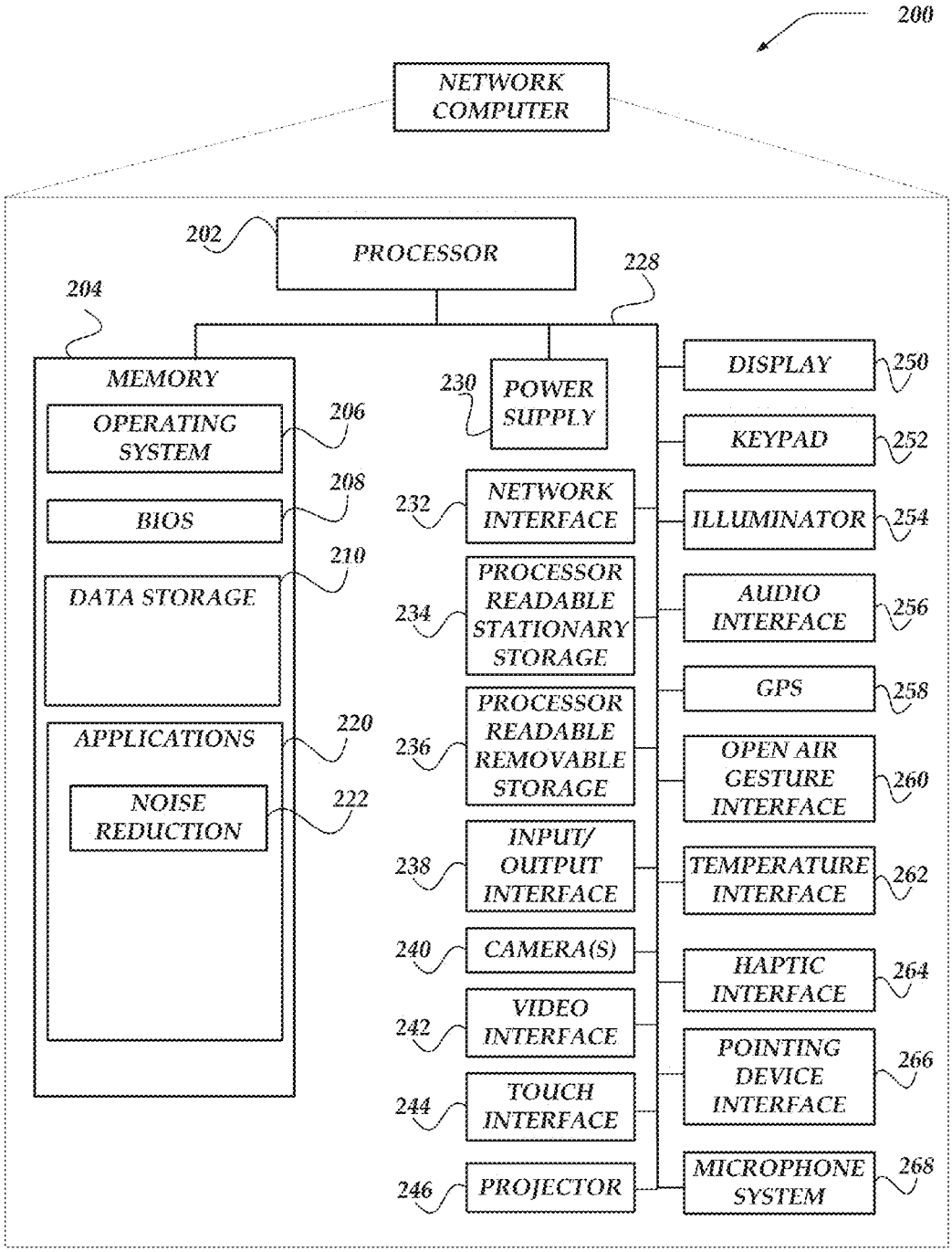
FIG. 2 shows an embodiment of a network computer that may be included in a system such as that shown in FIG. 1.

FIG. 2 shows one embodiment of network computer 200 that may include many more or less components than those shown. Network computer 200 may represent, for example, at least one embodiment of network computers 102-105 shown in FIG. 1.

Network computer 200 may include processor 202 in communication with memory 204 via bus 228. Network computer 200 may also include power supply 230, network interface 232, processor-readable stationary storage device 234, processor-readable removable storage device 236, input/output interface 238, camera(s) 240, video interface 242, touch interface 244, projector 246, display 250, keypad 252, illuminator 254, audio interface 256, global positioning systems (GPS) receiver 258, open air gesture interface 260, temperature interface 262, haptic interface 264, and pointing device interface 266. Network computer 200 may optionally communicate with a base station (not shown), or directly with another computer. And in one embodiment, although not shown, a gyroscope, accelerometer, or other technology (not illustrated) may be employed within network computer 200 to measuring and/or maintaining an orientation of network computer 200. In some embodiments, network computer 200 may include microphone system 268.

Power supply 230 may provide power to network computer 200. A rechargeable or non-rechargeable battery may be used to provide power. The power may also be provided by an external power source, such as an AC adapter or a powered docking cradle that supplements and/or recharges the battery.

Network interface 232 includes circuitry for coupling network computer 200 to one or more networks, and is constructed for use with one or more communication protocols and technologies including, but not limited to, protocols and technologies that implement any portion of the OSI model, GSM, CDMA, time division multiple access (TDMA), UDP, TCP/IP, SMS, MMS, GPRS, WAP, UWB, WiMax, SIP/RTP, GPRS, EDGE, WCDMA, LTE, UMTS, OFDM, CDMA2000, EV-DO, HSDPA, or any of a variety of other wireless communication protocols. Network interface 232 is sometimes known as a transceiver, transceiving device, or network interface card (NIC).

Audio interface 256 may be arranged to produce and receive audio signals such as the sound of a human voice. For example, audio interface 256 may be coupled to a speaker (not shown) and microphone (e.g., microphone system 268) to enable telecommunication with others and/or generate an audio acknowledgement for some action. A microphone in audio interface 256 can also be used for input to or control of network computer 200, e.g., using voice recognition, detecting touch based on sound, and the like. In some embodiments, audio interface 256 may be operative to communicate with microphone system 300 of FIG. 3. In microphone system 268 may include two or more microphones. In some embodiments, microphone system 268 may include hardware to perform noise reduction to received audio signals, as described herein.

Display 250 may be a liquid crystal display (LCD), gas plasma, electronic ink, light emitting diode (LED), Organic LED (OLED) or any other type of light reflective or light transmissive display that can be used with a computer. Display 250 may also include a touch interface 244 arranged to receive input from an object such as a stylus or a digit from a human hand, and may use resistive, capacitive, surface acoustic wave (SAW), infrared, radar, or other technologies to sense touch and/or gestures.

Projector 246 may be a remote handheld projector or an integrated projector that is capable of projecting an image on a remote wall or any other reflective object such as a remote screen.

Video interface 242 may be arranged to capture video images, such as a still photo, a video segment, an infrared video, or the like. For example, video interface 242 may be coupled to a digital video camera, a web-camera, or the like. Video interface 242 may comprise a lens, an image sensor, and other electronics. Image sensors may include a complementary metal-oxide-semiconductor (CMOS) integrated circuit, charge-coupled device (CCD), or any other integrated circuit for sensing light.

Keypad 252 may comprise any input device arranged to receive input from a user. For example, keypad 252 may include a push button numeric dial, or a keyboard. Keypad 252 may also include command buttons that are associated with selecting and sending images.

Illuminator 254 may provide a status indication and/or provide light. Illuminator 254 may remain active for specific periods of time or in response to events. For example, when illuminator 254 is active, it may backlight the buttons on keypad 252 and stay on while the mobile computer is powered. Also, illuminator 254 may backlight these buttons in various patterns when particular actions are performed, such as dialing another mobile computer. Illuminator 254 may also cause light sources positioned within a transparent or translucent case of the mobile computer to illuminate in response to actions.

Network computer 200 may also comprise input/output interface 238 for communicating with external peripheral devices or other computers such as other mobile computers and network computers. The peripheral devices may include a remote speaker/microphone system (e.g., device 300 of FIG. 3), headphones, display screen glasses, remote speaker system, or the like. Input/output interface 238 can utilize one or more technologies, such as Universal Serial Bus (USB), Infrared, WiFi, WiMax, Bluetooth™, wired technologies, or the like.

Haptic interface 264 may be arranged to provide tactile feedback to a user of a mobile computer. For example, the haptic interface 264 may be employed to vibrate network computer 200 in a particular way when another user of a computer is calling. Temperature interface 262 may be used to provide a temperature measurement input and/or a temperature changing output to a user of network computer 200. Open air gesture interface 260 may sense physical gestures of a user of network computer 200, for example, by using single or stereo video cameras, radar, a gyroscopic sensor inside a computer held or worn by the user, or the like. Camera 240 may be used to track physical eye movements of a user of network computer 200.

GPS transceiver 258 can determine the physical coordinates of network computer 200 on the surface of the Earth, which typically outputs a location as latitude and longitude values. GPS transceiver 258 can also employ other geo-positioning mechanisms, including, but not limited to, triangulation, assisted GPS (AGPS), Enhanced Observed Time Difference (E-OTD), Cell Identifier (CI), Service Area Identifier (SAI), Enhanced Timing Advance (ETA), Base Station Subsystem (BSS), or the like, to further determine the physical location of network computer 200 on the surface of the Earth. It is understood that under different conditions, GPS transceiver 258 can determine a physical location for network computer 200. In at least one embodiment, however, network computer 200 may, through other components, provide other information that may be employed to determine a physical location of the mobile computer, including for example, a Media Access Control (MAC) address, IP address, and the like.

Human interface components can be peripheral devices that are physically separate from network computer 200, allowing for remote input and/or output to network computer 200. For example, information routed as described here through human interface components such as display 250 or keyboard 252 can instead be routed through network interface 232 to appropriate human interface components located remotely. Examples of human interface peripheral components that may be remote include, but are not limited to, audio devices, pointing devices, keypads, displays, cameras, projectors, and the like. These peripheral components may communicate over a Pico Network such as Bluetooth™, Zigbee™ and the like. One non-limiting example of a mobile computer with such peripheral human interface components is a wearable computer, which might include a remote pico projector along with one or more cameras that remotely communicate with a separately located mobile computer to sense a user's gestures toward portions of an image projected by the pico projector onto a reflected surface such as a wall or the user's hand.

A mobile computer may include a browser application that is configured to receive and to send web pages, web-based messages, graphics, text, multimedia, and the like. The mobile computer's browser application may employ virtually any programming language, including a wireless application protocol messages (WAP), and the like. In at least one embodiment, the browser application is enabled to employ Handheld Device Markup Language (HDML), Wireless Markup Language (WML), WMLScript, JavaScript, Standard Generalized Markup Language (SGML), HyperText Markup Language (HTML), eXtensible Markup Language (XML), HTML5, and the like.

Memory 204 may include RAM, ROM, and/or other types of memory. Memory 204 illustrates an example of computer-readable storage media (devices) for storage of information such as computer-readable instructions, data structures, program modules, or other data. Memory 204 may store BIOS 208 for controlling low-level operation of network computer 200. The memory may also store operating system 206 for controlling the operation of network computer 200. It will be appreciated that this component may include a general-purpose operating system (e.g., a version of Microsoft Corporation's Windows or Windows Phone™, Apple Corporation's OSX™ or iOS™, Google Corporation's Android, UNIX, LINUX™, or the like). In other embodiments, operating system 206 may be a custom or otherwise specialized operating system. The operating system functionality may be extended by one or more libraries, modules, plug-ins, or the like.

Memory 204 may further include one or more data storage 210, which can be utilized by network computer 200 to store, among other things, applications 220 and/or other data. For example, data storage 210 may also be employed to store information that describes various capabilities of network computer 200. The information may then be provided to another device or computer based on any of a variety of events, including being sent as part of a header during a communication, sent upon request, or the like. Data storage 210 may also be employed to store social networking information including address books, buddy lists, aliases, user profile information, or the like. Data storage 210 may further include program code, data, algorithms, and the like, for use by a processor, such as processor 202 to execute and perform actions. In one embodiment, at least some of data storage 210 might also be stored on another component of network computer 200, including, but not limited to, non-transitory processor-readable removable storage device 236, processor-readable stationary storage device 234, or even external to the mobile computer.

Applications 220 may include computer executable instructions which, when executed by network computer 200, transmit, receive, and/or otherwise process instructions and data. Examples of application programs include, but are not limited to, calendars, search programs, email client applications, IM applications, SMS applications, Voice Over Internet Protocol (VOIP) applications, contact managers, task managers, transcoders, database programs, word processing programs, security applications, spreadsheet programs, games, search programs, and so forth.

In some embodiments, applications 200 may include noise reduction 222. Noise reduction 222 may be employed to reduce environmental noise and enhance target speech in an audio signal (such as signals received through microphone system 268).

In some embodiments, hardware components, software components, or a combination thereof of network computer 200 may employ processes, or part of processes, similar to those described herein.

Illustrative Microphone System

FIG. 3 shows one embodiment of microphone system 300 that may include many more or less components than those shown. System 300 may represent, for example, at least one embodiment of microphone system 110 shown in FIG. 1. In various embodiments, system 300 may be a standalone device or remotely located (e.g., physically separate from) to another device, such as network computer 200 of FIG. 2. In other embodiments, system 300 may be incorporated into another device, such as network computer 200 of FIG. 2.

Although microphone system 300 is illustrated as a single device—such as a remote speaker system with hands-free telecommunication capability (e.g., includes a speaker, a microphone, and Bluetooth capability to enable a user to telecommunicate with others)—embodiments are not so limited. For example, in some other embodiments, microphone system 300 may be employed as multiple separate devices, such as a remote speaker system and a separate remote microphone that together may be operative to enable hands-free telecommunication. Although embodiments are primarily described as a smart phone utilizing a remote speaker with microphone system, embodiments are not so limited. Rather, embodiments described herein may be employed in other systems, such as, but not limited to sounds bars with phone call capability, home theater systems with phone call capability, mobile phones with speaker phone capability, automobile devices with hands-free phone call capability, voice recorders, or the like.

In any event, system 300 may include processor 302 in communication with memory 304 via bus 310. System 300 may also include power supply 312, input/output interface 320, speaker 322 (optional), microphones 324, and processor-readable storage device 316. In some embodiments, processor 302 (in conjunction with memory 304) may be employed as a digital signal processor within system 300. So, in some embodiments, system 300 may include speaker 322, microphone array 324, and a chip (noting that such a system may include other components, such as a power supply, various interfaces, other circuitry, or the like), where the chip is operative with circuitry, logic, or other components capable of employing embodiments described herein.

Power supply 312 may provide power to system 300. A rechargeable or non-rechargeable battery may be used to provide power. The power may also be provided by an external power source, such as an AC adapter that supplements and/or recharges the battery.

Speaker 322 may be a loudspeaker or other device operative to convert electrical signals into audible sound. In some embodiments, speaker 322 may include a single loudspeaker, while in other embodiments, speaker 322 may include a plurality of loudspeakers (e.g., if system 300 is implemented as a soundbar).

Microphones 324 may include a plurality of microphones that are operative to capture audible sound and convert them into electrical signals. In various embodiments, the microphones may be physically positioned/configured/arranged on system 300 to logically define a physical space relative to system 300 into a plurality of regions, such as a target speech region (e.g., a microphone in a headset towards a speaker's mouth, directional listening, or the like) and a noise region (e.g., a microphone in a headset away a speaker's mouth, directional listening, or the like).

In at least one of various embodiments, speaker 322 in combination with microphones 324 may enable telecommunication with users of other devices.

System 300 may also comprise input/output interface 320 for communicating with other devices or other computers, such as network computer 200 of FIG. 2, or other mobile/network computers. Input/output interface 320 can utilize one or more technologies, such as Universal Serial Bus (USB), Infrared, WiFi, WiMax, Bluetooth™, wired technologies, or the like.

Although not illustrated, system 300 may also include a network interface, which may operative to couple system 300 to one or more networks, and may be constructed for use with one or more communication protocols and technologies including, but not limited to, protocols and technologies that implement any portion of the OSI model, GSM, CDMA, time division multiple access (TDMA), UDP, TCP/IP, SMS, MMS, GPRS, WAP, UWB, WiMax, SIP/RTP, GPRS, EDGE, WCDMA, LTE, UMTS, OFDM, CDMA2000, EV-DO, HSDPA, or any of a variety of other wireless communication protocols. Such a network interface is sometimes known as a transceiver, transceiving device, or network interface card (NIC).

Memory 304 may include RAM, ROM, and/or other types of memory. Memory 304 illustrates an example of computer-readable storage media (devices) for storage of information such as computer-readable instructions, data structures, program modules, or other data. Memory 304 may further include one or more data storage 306. In some embodiments, data storage 306 may store, among other things, applications 308. In various embodiments, data storage 306 may include program code, data, algorithms, and the like, for use by a processor, such as processor 302 to execute and perform actions. In one embodiment, at least some of data storage 306 might also be stored on another component of system 300, including, but not limited to, non-transitory processor-readable storage 316.

Applications 308 may include noise reduction 332, which may be enabled to employ embodiments described herein and/or to employ processes, or parts of processes, similar to those described herein. In some embodiments, hardware components, software components, or a combination thereof of system 300 may employ processes, or part of processes, similar to those described herein.

Example Microphone Environment

Figure 4:
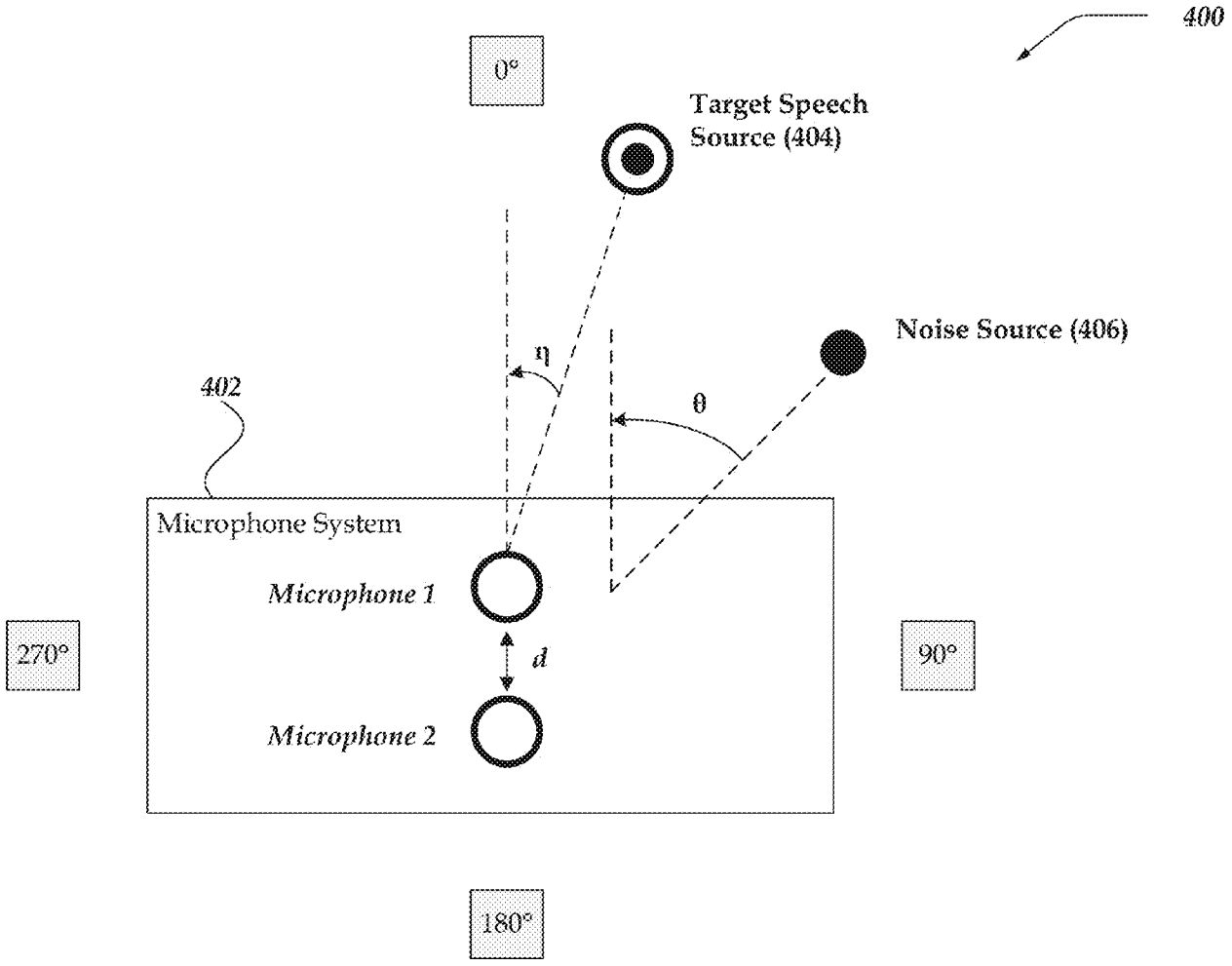
FIG. 4 illustrates an example use-case environment and scenario for employing embodiments described herein.

FIG. 4 illustrates an example use-case environment and scenario for employing embodiments described herein. Environment 400 may include microphone system 402, target speech source 404, and noise source 406. Microphone system 402 may be an embodiment of microphone system 110 of FIG. 1. Microphone system 402 may include two microphones that are separated by distance d.

Target speech source 404 may be the source of the speech to be enhanced by the microphone system, as described herein. In contrast, noise source 406 may be the source of other non-target audio, i.e., noise, to be reduced/canceled/removed from the audio signals received at the microphones to create an enhanced target speech audio signal, as described herein.

$\eta$ is the angle of incidence of the target speech source 404. In various embodiments, $\eta$ may be known or estimated. For example, with a headset, the target speech is often close to a primary microphone positioned towards the speaker. In other embodiments, $\eta$ may be unknown, but may be estimated by a various direction-of-arrival techniques.

$\theta$ is the angle of incidence of the noise source 406. In various embodiments, $\theta$ may be known or unknown. It should be understood that noise within environment 400 may be from a plurality of noise sources from different directions. So, $\theta$ may be based on an average of the noise sources, based on a predominant noise source direction, estimated, or the like. In some embodiments, $\theta$ may be estimated based on the positioning of the microphones to a possible noise source. For example, with a headset, the noise is probably going to be approximate 180 degrees from a primary microphone and the target speech. In other embodiments, $\theta$ may be estimated based on directional beamforming techniques.

In this type of environment, a coherence function of the input signals from a two microphone system can be modeled based on the environmental field. For example, taking the Short-Time Fourier Transform (STFT) of the time domain signals received at the microphones, the input in each time-frame (or window) and frequency bin can be written as the sum of the clean speech (i.e., X) and noise (i.e., N) signals as follows:

$$Y_i(\omega,m)=X_i(\omega,m)+N_i(\omega,m), \tag{1}$$

where $i=\{1,2\}$ denotes the microphone index, m is the time-frame index (window) and $\omega$ the angular frequency (varies in the range of $[-\pi,\pi)$). Coherence is a complex valued function and a measure of the correlation between the input signals at two microphones, often defined as $$\Gamma_{y1y2}(\omega, m) = \frac{\phi_{y1y2}(\omega, m)}{\sqrt{\phi_{y1y1}(\omega, m)\phi_{y2y2}(\omega, m)}} \tag{2}$$

where $\phi_{uu}$ denotes the power spectral density (PSD), and $\phi_{uv}$ the cross-power spectral density (CSD) of two arbitrary signals. In various embodiments, the magnitude of the coherence function (typically with values in the range of [0,1]) can be utilized as a measure to determine whether the target speech signal is present or absent at a specific frequency bin. It should be recognized that other coherence functions may be also be employed with embodiments described herein.

In multi-microphone speech processing, two assumptions on the environmental (noise) fields are common, a coherent noise field and a diffuse noise field. The coherent noise field can be assumed to be generated by a single well-defined directional sound source. In the coherent field, the microphones outputs are perfectly correlated except for a time delay and the coherence function of the two input signals can be analytically modeled by:

$$\Gamma_{u1u2}(\omega)=e^{j\omega\tau\cos\theta}, \tag{3}$$

where $\tau=f_s(d/c)$, d inter-microphone distance, c is speed of sound, $\theta$ the angle of incidence, and $f_s$ is the sampling frequency (measured in Hz).

The diffuse noise field ban be characterized by uncorrelated noise signals of equal power propagating in all directions simultaneously. In general, in highly reverberant environments, the environmental noise can bear the characteristics of the diffuse noise field, where the coherence function is real-valued and can be analytically modeled by:

$$\Gamma_{u1u2}(\omega)=\mathrm{sinc}(\omega\tau), \tag{4}$$

where $\mathrm{sinc}(\gamma)=\sin\gamma/\gamma$, and the first zero crossing of the function is at c/2d Hz.

It should be pointed out here that in addition to the coherent and diffuse fields, the incoherent noise field may also be considered. Incoherent noise field may be assumed where the signals at the channels are highly uncorrelated and the coherence function gets values very close to zero. Effectiveness of multi-microphone speech enhancement techniques can be highly dependent on the characteristics of the environmental noise where they are tested. In general, the performance of techniques that work well in diffuse noise fields typically start to degrade when evaluated in coherent fields and vice versa.

In some scenarios, a coherence-based dual-microphone noise reduction technique in anechoic (also low reverberant) rooms, where the noise field is highly coherent, can offer improvements over a beamformer in terms of both intelligibility and quality of the enhanced signal. However, this technique can start to degrade when tested inside a more reverberant room. One reason of this degradation can be attributable to the algorithm's assumption that the signals received by the two microphones are purely coherent (i.e., an ideal coherent field). Although this assumption is valid for low reverberant environments, the coherence function gets the characteristics of diffuse noise in more reverberant conditions, and therefore, the algorithm loses its effectiveness.

As described in more detail below, the modeling of the coherence function may be modified in such a way that it takes into account both the analytical models of the coherent and diffuse acoustical fields to better reduce noise from both anechoic and reverberant environments without having to change noise reduction techniques depending on the environment.

Example System Diagram

Figure 5:
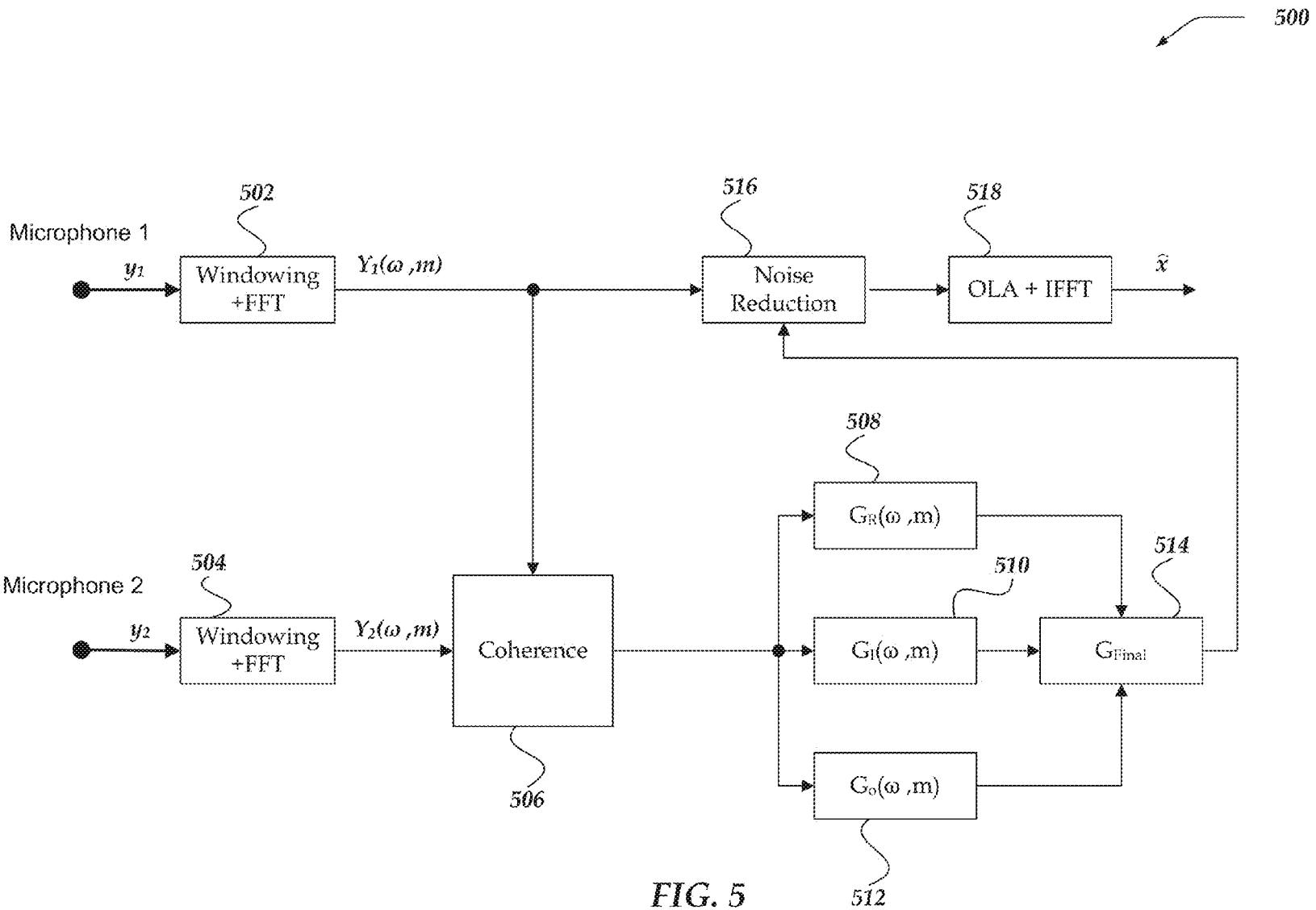
FIG. 5 illustrates a block diagram generally showing a system that may be employed in accordance with embodiments described herein.

FIG. 5 illustrates a block diagram generally showing a system that may be employed in accordance with embodiments described herein. Example 500 may include windowing and fast Fourier transform (FFT) modules 502 and 504; coherence module 506; gain function modules 508, 510, and 512; final gain function module 514; noise reduction module 516; and inverse FFT (IFFT) and overlap-add (OLA) module 518.

Signal $y_1$ may be output from microphone 1 and provided to module 502. Module 502 may perform a FFT on signal $y_1$ to convert the signal from the time domain to the frequency domain. Module 502 may also perform windowing to generate overlapping time-frame indices. In some embodiments, module 502 may process signal $y_1$ in 20 ms frames with a Hanning window and a 50% overlap between adjacent frames. It should be noted that other windowing methods and/or parameters may also be employed. The output of module 502 may be $Y_1(\omega, m)$, where m is the time-frame index (or window) and co is the angular frequency.

Signal $y_2$ may be output from microphone 2 and provided to module 504. Module 504 may perform embodiments of module 502, but to signal $y_2$, which may result in an output of $Y_2(\omega, m)$.

$Y_1(\omega, m)$ and $Y_2(\omega, m)$ may be provided to coherence module 506. As described above, coherence is a complex valued function and a measure of the correlation between the input signals at two microphones. Coherence module 506 may calculate the coherence function between $Y_1(\omega, m)$ and $Y_2(\omega, m)$. In various embodiments, coherence module 506 may calculate the coherence function using Eq. (2), which is reproduced here for convenience, $$\Gamma_{y1y2}(\omega, m) = \frac{\phi_{y1y2}(\omega, m)}{\sqrt{\phi_{y1y1}(\omega, m)\phi_{y2y2}(\omega, m)}},$$

where $\phi_{uu}$ denotes the PSD, and $\phi_{uv}$ the CSD of two arbitrary signals, such as $Y_1(\omega, m)$ and $Y_2(\omega, m)$. It should be recognized that other mechanisms for calculating the coherence function may also be employed by coherence module 506.

In some embodiments, the PSD may be determined based on the following first-order recursive equation:

$$\phi_{y_iy_i}(\omega,m)=\lambda\phi_{y_iy_i}(\omega,m-1)+(1-\lambda)|Y_i(\omega,m)|^2\{i=1,2\} \quad (5)$$

Similarly, in some embodiments, the CSD may be determined based on the following first-order recursive equation:

$$\phi_{y_1y_2}(\omega,m)=\lambda\phi_{y_1y_2}(\omega,m-1)+(1-\lambda)Y_1(\omega,m)Y_2^*(\omega,m) \quad (6)$$

where (.)* denotes the complex conjugate operator, and λ is a forgetting factor, set between 0 and 1.

The output of module 506 is provided to modules 508, 510, and 512 where multiple gain functions are determined. Briefly, module 508 determines the gain function for the real portion of a modified coherence function using Eq. (16); module 510 determines the gain function for the imaginary portion of the modified coherence function using Eq. (16), and module 512 determines a gain function for attenuating frequency components outside of an expected range, as further explained below.

But first, consider the system configuration shown in FIG. 4, i.e., one target speech and one directional noise source. The coherence function between the noisy input signals at two microphones can be obtained by the weighted sum of the coherence of clean speech and noise signals at the two channels (i.e., microphones). This relationship may be expressed by the following equation:

$$\Gamma_{y1y2} = \Gamma_{x1x2}\frac{S\hat{N}R}{1+S\hat{N}R} + \Gamma_{n1n2}\frac{1}{1+S\hat{N}R}, \quad (7)$$

where $\Gamma_{x1x2}$ and $\Gamma_{n1n2}$ denote the coherence function between a clean speech signal and a noise signal at the two microphones, respectively. In some embodiments, it may be assumed that the signal to noise ratio (SNR) at the two channels is nearly identical. This assumption may be valid due to close spacing of the two microphones. So $S\hat{N}R$ denotes nearly identical SNR at both microphones. It should be noted that in the various equations herein the angular frequency and frame indices may be omitted for better clarity.

In some embodiments, Eq. (3) may be incorporated into Eq. (7) under the assumption of a purely coherent field in the environment, which can result in Eq. (7) being rewritten as, $$\Gamma_{y1y2} = [\cos(\omega'\cos\eta) + j\sin(\omega'\cos\eta)]\frac{S\hat{N}R}{1+S\hat{N}R} + [\cos(\omega'\cos\theta) + j\sin(\omega'\cos\theta)]\frac{1}{1+S\hat{N}R} \quad (8)$$

where η is the angle of incidence of the target speech, θ is that of the noise source, and ω'=ωτ. In some embodiments, the $S\hat{N}R$ can be estimated based on a quadratic equation obtained from real and imaginary parts of the last equation.

Unfortunately, even in a mild reverberant room, the received signals by the two microphones are generally not purely coherent, and therefore, Eq. (3) may not efficiently model the coherence function. In various embodiments, the model defined in Eq. (8) may be modified to consider multi-path reflections (diffuseness) present in a reverberation environment. To do this modification, the coherence between the input noisy signals can be modeled by the following equation:

$$\Gamma_{y1y2} = [K_1\cos\beta + (1-K_1)\mathrm{sinc}(\omega') + j\sin\beta]\frac{S\hat{N}R}{1+S\hat{N}R} + [K_2\cos\alpha + (1-K_2)\mathrm{sinc}(\omega') + j\sin\alpha]\frac{1}{1+S\hat{N}R} \quad (9)$$

where α=ω' cos θ, β=ω' cos η, $K_1$ and $K_2$ are coefficients obtained by mapping the direct-to-reverberant energy ratio (DRR) into the range of (0,1). $K_1$ and $K_2$ may be determined by the following equation:

$$K_h(\omega) = \frac{DRR(\omega)}{DRR(\omega)+1} \quad h = \{1, 2\}. \tag{10}$$

$K_1$ and $K_2$ may be calculated and updated in the frames where the target speech and interference signals are dominant. It should be noted that the subscript h in this equation should not be confused with subscript i which is the microphone index. The criteria for updating $K_1$ and $K_2$ is described in more detail below. By setting $K_1=K_2=1$ (i.e., a purely coherent field), the model in Eq. (9) is similar to that in Eq. (8).

DRR or direct-to-reverberant energy ratio represents the ratio between the signals received by microphones corresponding to the direct path (i.e., coherent signal) and those subject to the multipath reflections (diffuseness). The DRR is an acoustic parameter often helpful for determining some important characteristics of a reverberant environment such as reverberation time, diffuseness, or the like. This ratio can enable the system to handle both coherent and non-coherent noise signals present in the environment. In various embodiments, DRR may be calculated by:

$$DRR(\omega) = \frac{|\mathrm{sinc}(\omega\tau)|^2 - |\Gamma_{y1y2}|^2}{|\Gamma_{y1y2}|^2 - 1} \tag{11}$$

where $\Gamma_{y1y2}$ may be calculated from Eq. (2).

The real part of Eq. (9) can be illustrated in the following equation:

$$\Re = [K_1\cos\beta + (1-K_1)\mathrm{sinc}(\omega')] \frac{S\hat{N}R}{1+S\hat{N}R} + [K_2\cos\alpha + (1-K_2)\mathrm{sinc}(\omega')]\frac{1}{1+S\hat{N}R} \tag{12}$$

where $\Gamma$ is the real part of the input signal's coherence function. At higher input SNRs, where the target speech is dominant, term $$\frac{S\hat{N}R}{1+S\hat{N}R}$$

taxes values close to one, and term $$\frac{1}{1+S\hat{N}R}$$

takes values close to zero. Therefore, the real part of the coherence function at high SNRs (i.e., $\Re$) can be approximated as:

$$\bar{\Re} = K_1 \cos\beta + (1-K_1)\mathrm{sinc}(\omega'). \tag{13}$$

A suppression filter (or gain function), which takes values close to one when $\Re$ is close to $\bar{\Re}$ (i.e., an indication for high input SNR), and values close to zero when these two terms have values far apart from each other, which is illustrated by Eq. (16) and Eq. (17).

The imaginary part of Eq. (9) can be illustrated in the following equation:

$$\Im = \sin\beta\frac{S\hat{N}R}{1+S\hat{N}R} + \sin\alpha\frac{1}{1+S\hat{N}R} \tag{14}$$

where $\Im$ is the imaginary part of the input signals coherence function. In a manner similar to the discussion above, at high input SNRs the imaginary part of the coherence function (i.e., $\Im$) will be an approximate of:

$$\bar{\Im} = \sin\beta. \tag{15}$$

Again, the suppression filter takes values close to one when $\Im$ and $\bar{\Im}$ are close to each other, and takes values close zero when $\Im$ is at significant distance away from $\bar{\Im}$, which is illustrated by Eq. (16) and Eq. (18).

Since all of the four terms, $\Re$, $\bar{\Re}$, $\Im$ and $\bar{\Im}$, are in the range of [−1,1], the maximum possible distance between each pair is 2. So, the gain function that maps input distance value 0 to the output gain 1 (i.e., minimum distance to maximum gain), and input value 2 to 0 (i.e., maximum distance to minimum gain). The gain function results in the following equation:

$$G_l = 1-(dis_l/2)^P \quad l = \{\Re, \Im\}, \tag{16}$$

where $$dis_{\Re} = |\Re - \bar{\Re}|, \tag{17}$$

and $$dis_{\Im} = |\Im - \bar{\Im}|. \tag{18}$$

In various embodiments, Eq. (16) may be employed at module 508 for real components as modeled in Eq. (17) and Eq. (16) may be employed at module 510 for imaginary components as modeled in Eq. (18).

Figure 6:
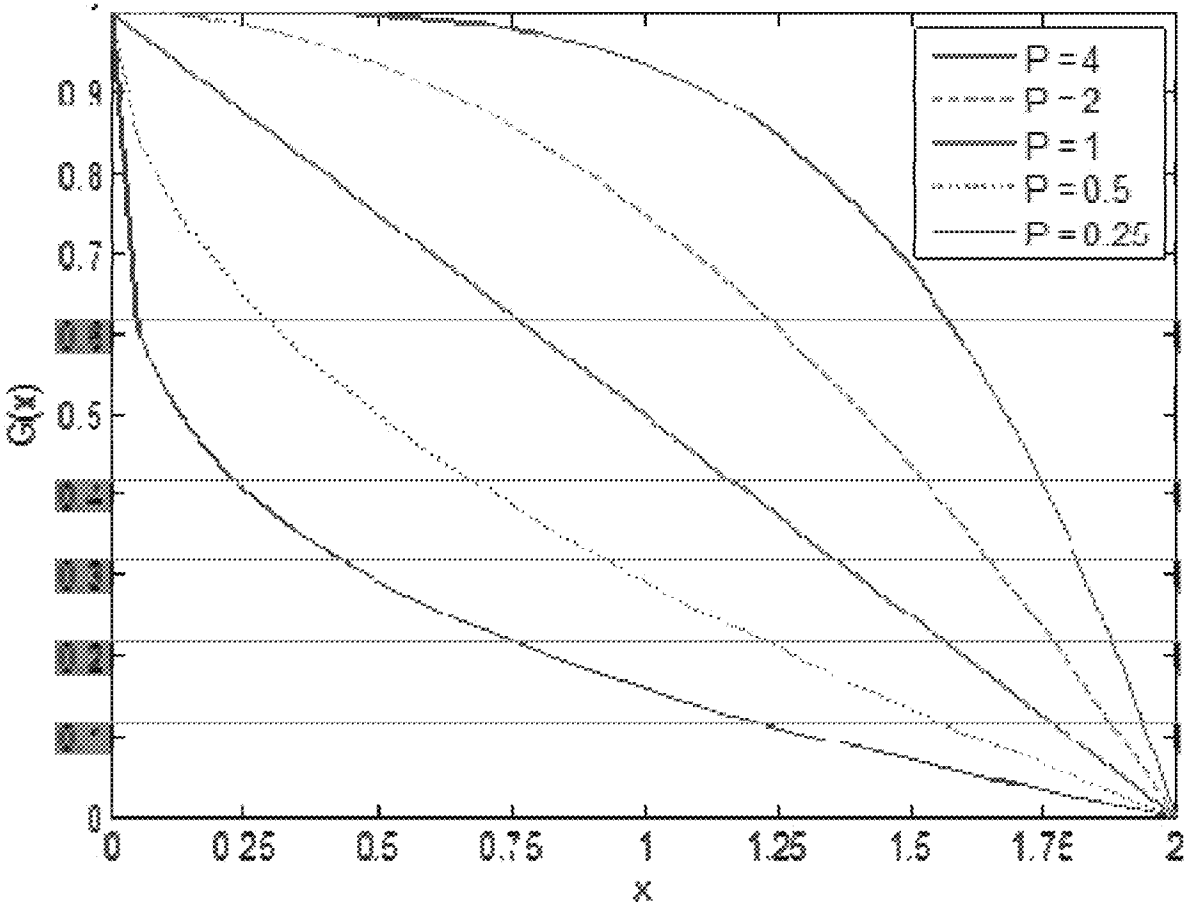
FIG. 6 illustrates an example plot of a gain function employed in accordance with embodiments described herein.

The value P in Eq. (16), can be set to adjust the aggressiveness of the filter. Lower P values yields a more aggressive gain function than higher P values. FIG. 6 shows a plot of function $G(x)=1-(x/2)^P$ for different values of x in the range of [0,2]. As illustrated in the figure, with values of P greater than 1 the gain function takes values very close to 1, when the distances in Eq. (17) and Eq. (18) are in the range of [0,5]. In one non-exhaustive and non-limiting example, P may have a value of 0.5.

As mentioned earlier, in order to compute $k_1$, Eq. (10) may be utilized, and the value updated in frames that the speech signal is dominant. The criterion for detection of speech superiority over noise may be $\bar{G}_l>0.5$, where $\bar{G}_l$ is equal to mean of z,41 over all frequency bins in each frame. Since $\bar{G}_1$ in the current frame may be computed after the computation of $k_1$, the value of $\bar{G}_l$ in the previous frame may be used for this update. The DRR in Eq. (10) may have an operating range of −30 dB to 30 dB, and therefore, the values below and above this range represent purely diffuse and purely coherent noise fields, respectively (i.e., K=0 or 1). It should be recognized that other ranges may also be modeled.

In addition to determining the gain functions for the real and imaginary parts of the coherence function (e.g., at modules 508 and 510), a zero gain function may also be determined by module 512. From Eq. (12), in high input SNRs—where the real part of the coherence function (i.e., $\Re$) takes values close to $\bar{\Re} = K_1 \cos\beta + (1-K_1)\,\mathrm{sinc}(\omega')$, and based on the fact that $0<K_1<1$—the following condition may be met:

$$\min\{\cos\beta, \mathrm{sinc}(\omega')\} < R < \max\{\cos\beta, \mathrm{sinc}(\omega')\}. \tag{19}$$

At high SNR (e.g. 30 dB), where the speech signal is dominant, the real part of the coherence function may be bounded to the range described in Eq. (19). So, at frequency components where the noise is present, the likelihood of the violation of condition in Eq. (19) increases. Based on this conclusion, the zero gain filter can attenuate the frequency components where $\Re$ is not in the desired range (and let the other components to be passed without attenuation), which can result in additional amounts of noise being suppressed. Consequently, the noise reduction filter employed by module 512 may be defined as $$G_o = \begin{Bmatrix} \mu, & \text{if condition in } Eq. \text{ (19) not held} \\ 1, & \text{otherwise} \end{Bmatrix}, \tag{20}$$

where μ is a small positive spectral flooring constant close to zero. By decreasing the value of μ, the level of noise reduction at the expense of imposing extra speech distortion increases. It should be noted that by setting μ=0 the algorithm may introduce spurious peaks in the spectrum of the enhanced output, which can cause musical noise. So, a small positive constant close to zero may be chosen for μ. In one non-exhaustive and non-limiting example, μ may have a value of 0.1.

Figure 7:
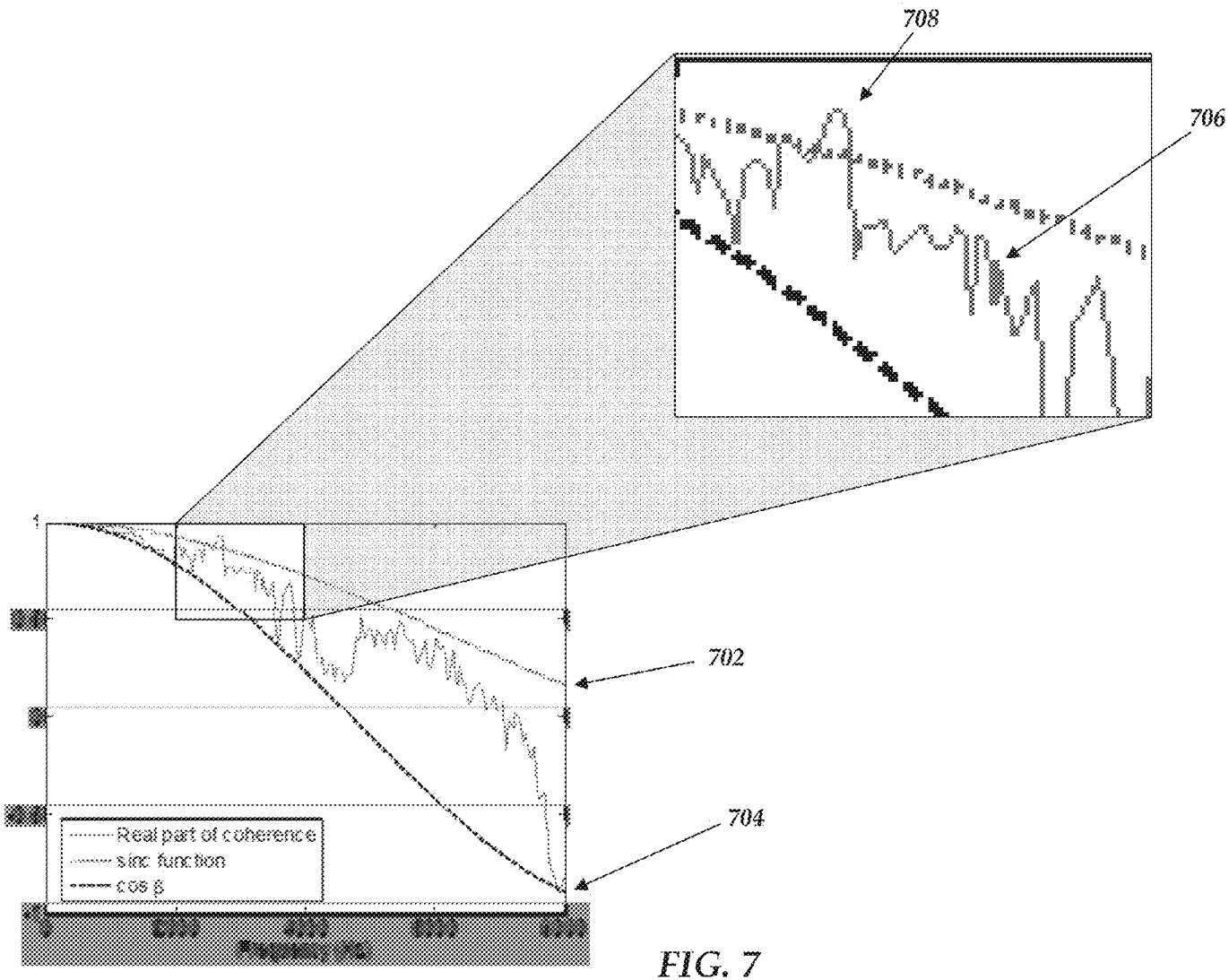
FIG. 7 illustrates an example plot of a real part of a coherence function employed in accordance with embodiments described herein.

FIG. 7 illustrates $\Re$ and the corresponding ranges defined by Eq. (19). Elements 702 and 704 illustrate the boundaries of this range. Element 706 illustrates $\Re$ for a given frequency range. Element 708 illustrates a frequency where $\Re$ is outside of the range defined by Eq. (19). Accordingly, for the frequency bin associated with element 708, $G_o=\mu$ and for other frequency bins where $\Re$ is within the range defined by elements 702 and 704, $G_o=1$.

Returning to FIG. 5, the outputs of modules 508, 510, and 512 may be provided to final gain module 514, which may be defined as follows:

$$G_{Final}=(G_{\Re}G_{\Im}\,G_o)^Q, \tag{21}$$

where Q is a parameter for setting the aggressiveness of the final gain function. In various embodiments, the higher the Q value, the more aggressive the final gain function (i.e., resulting in higher noise suppression). In one non-exhaustive and non-limiting example, Q may have a value of 3.

The output ($G_{Final}$) of module 514 may be provided to noise reduction module 516, where the gain function $G_{Final}$ is applied to $Y_1(\omega, m)$. To reconstruct the enhanced signal $\hat{x}$, module 518 applies the inverse FFT to the output of noise reduction 516, and module 518 synthesizes the signal using the overlap-add (OLA) method, which results in an enhanced audio signal in the time domain.

It should be recognized, that since each gain function described herein is in the frequency domain, they may be vectors and determined for each of a plurality of frequency bins for each time sampled window.

Also, in various embodiments, more than two microphones may be employed. In such embodiments, each microphone pair may be utilized such that embodiments described herein may be applied to each microphone pair. The resulting enhanced signal for each microphone pair may be correlated or otherwise combined to create a final enhanced audio signal for system with more than two microphones.

General Operation

Operation of certain aspects of the invention will now be described with respect to FIGS. 8 and 9. In at least one of various embodiments, at least a portion of processes 800 and 900 described in conjunction with FIGS. 8 and 9, respectively, may be implemented by and/or executed on one or more network computers, such as microphone system 300 of FIG. 3. Additionally, various embodiments described herein can be implemented in a system such as system 100 of FIG. 1.

Figure 8:
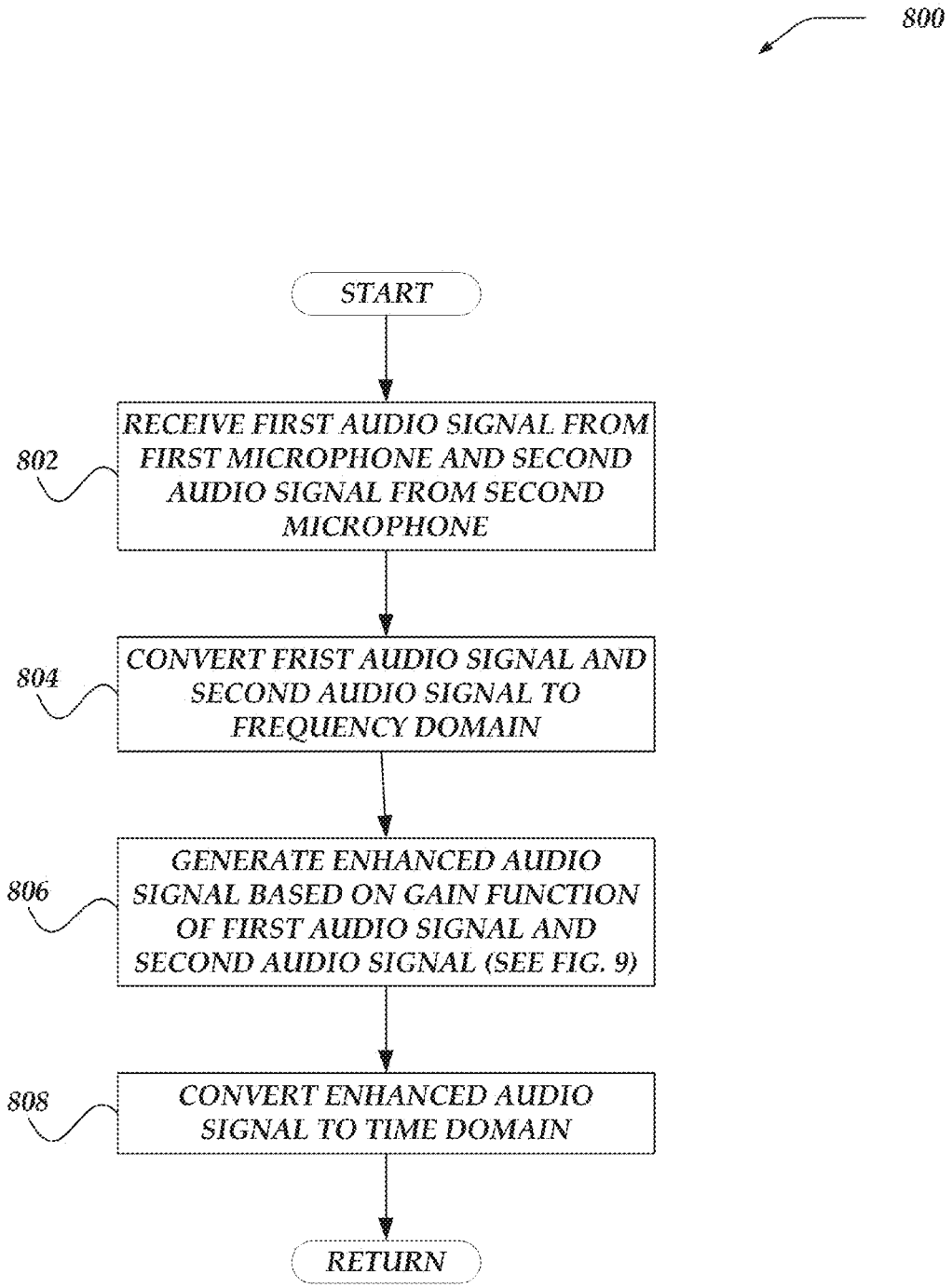
FIG. 8 illustrates a logical flow diagram generally showing an embodiment of an overview process for generating an enhanced audio signal with noise reduction in accordance with embodiments described herein.

FIG. 8 illustrates a logical flow diagram generally showing an embodiment of an overview process for generating an enhanced audio signal with noise reduction. Process 800 may begin, after a start block, at block 802, where a first audio signal and a second audio signal may be received from a first microphone and a second microphone, respectively.

Process 800 may proceed to block 804, where the first audio signal and the second audio signal are converted from the time domain to the frequency domain. In various embodiments, this conversion may be performed by employing a FFT and a windowing mechanism. In some embodiments, the windowing may be for 20 millisecond windows or frames.

Process 800 may continue to block 806, where an enhanced audio signal may be generated, which is described in greater detail below in conjunction with FIG. 9. Briefly, however, multiple gain functions may be determined and combined to create final gain function, which may be applied to the first audio signal.

Process 800 may proceed next to block 808, where the enhanced audio signal may be converted back to the time domain. In various embodiments, an IFFT and OLA (i.e., reverse windowing) method may be employed to convert the enhanced signal from the frequency domain to the time domain.

After block 808, process 800 may terminate and/or return to a calling process to perform other actions.

Figure 9:
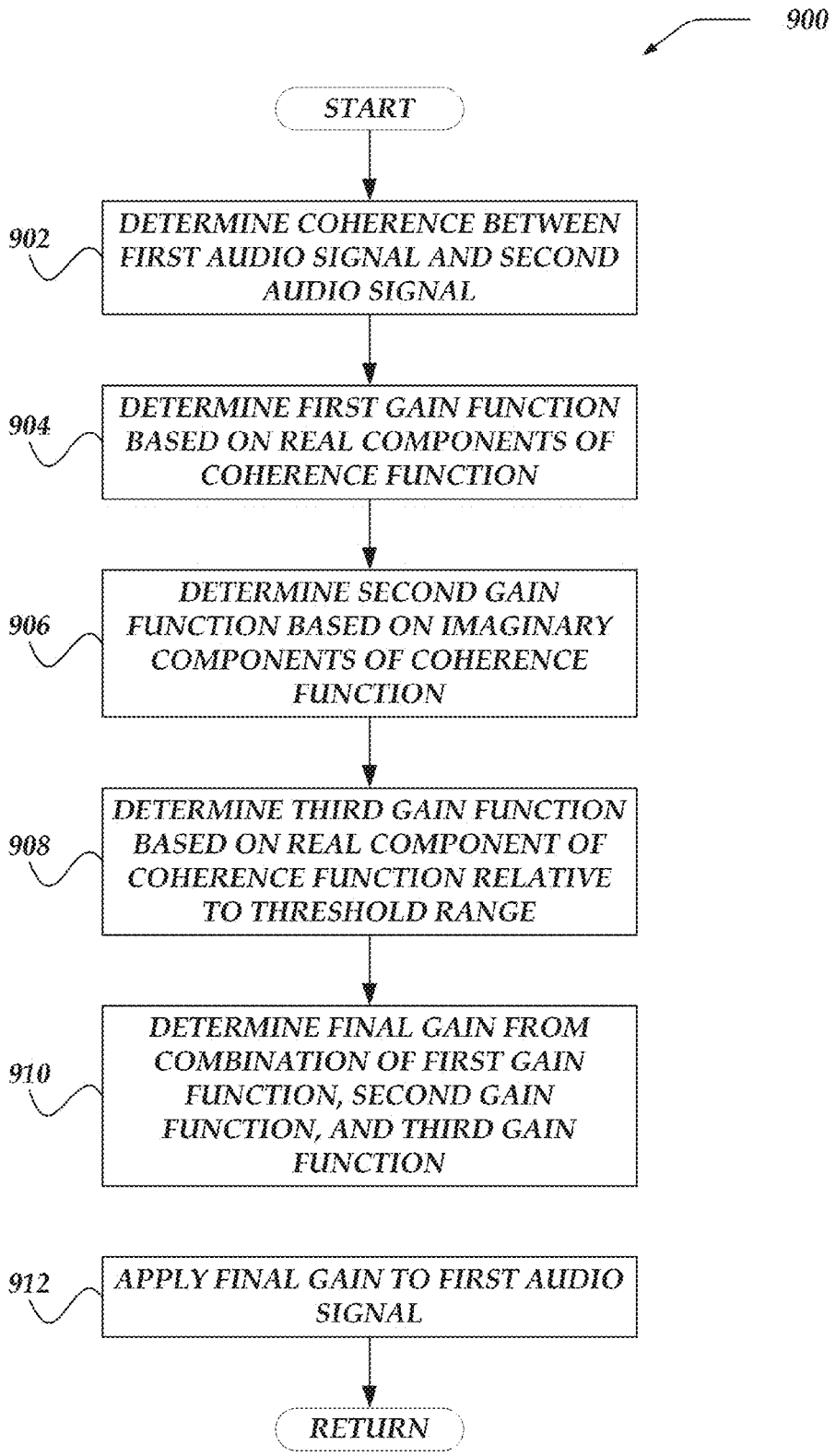
FIG. 9 illustrates a logical flow diagram generally showing an embodiment of a process for determining a final gain function based on a combination of gain functions generated from a coherence function in accordance with embodiments described herein.

FIG. 9 illustrates a logical flow diagram generally showing an embodiment of a process for determining a final gain function based on a combination of gain functions generated from a coherence function in accordance with embodiments described herein.

Process 900 may begin, after a start block, at block 902, where a coherence may be determined between a first audio signal from a first microphone and a second audio signal from a second microphone. In various embodiments, the coherence may be determine by employing Eq. (2). However, embodiments are not so limited and other mechanisms for determining coherence between two audio signals may also be employed.

Process 900 may proceed to block 904, where a first gain function may be determined based on real components of a coherence function. In various embodiments, the first gain function may be determined, such as by module 508 of FIG. 5, from the real components of Eq. (16), which utilizes Eq. (12), Eq. (13), and Eq. (17).

Process 900 may continue at block 906, where a second gain function may be determined based on imaginary components of the coherence function. In various embodiments, the second gain function may be determined, such as by module 510 of FIG. 5, from the imaginary components of Eq. (16), which utilizes Eq. (14), Eq. (15), and Eq. (18).

Process 900 may proceed next to block 908, where a third gain function may be determined based on a relationship between a real component of the coherence function and a threshold range. In various embodiments, the third gain function may be determined such as by module 512 of FIG. 5, from Eq. (20), where the threshold range is determined by Eq. (19).

Process 900 may continue next at block 910, where a final gain may be determined from a combination of the first gain function, the second gain function, and the third gain function. In various embodiments, the final gain may be determined, such as by module 514 of FIG. 5, from Eq. (21). In some embodiments, an aggressiveness parameter may be applied to the combination of gain functions. In at least one of various embodiments, this parameter may be an exponent of the product of the first, second, and third gain functions.

Process 900 may continue next at block 912, where the final gain may be applied to the first audio signal. In various embodiments, the first audio signal may be the audio signal from a primary microphone where the target speech is the most prominent (e.g., higher SNR). Often, the primary microphone may be the microphone closest to the target speech source. In some embodiments, this microphone may be known, such as in a headset it would be the microphone closest to the speaker's mouth. In other embodiments, various direction-of-arrival mechanisms may be employed to determine which of the two microphones is the primary microphone.

After block 912, process 900 may terminate and/or return to a calling process to perform other actions. It should be recognized that process 900 may continuously loop for each window or frame of the input audio signals. In this way, the enhanced audio signal may be calculated in near real time to the input signal being received (relative to the computation time to enhance the signal).

It should be understood that the embodiments described in the various flowcharts may be executed in parallel, in series, or a combination thereof, unless the context clearly dictates otherwise. Accordingly, one or more blocks or combinations of blocks in the various flowcharts may be performed concurrently with other blocks or combinations of blocks. Additionally, one or more blocks or combinations of blocks may be performed in a sequence that varies from the sequence illustrated in the flowcharts.

Further, the embodiments described herein and shown in the various flowcharts may be implemented as entirely hardware embodiments (e.g., special-purpose hardware), entirely software embodiments (e.g., processor-readable instructions), user-aided, or a combination thereof. In some embodiments, software embodiments can include multiple processes or threads, launched statically or dynamically as needed, or the like.

The embodiments described herein and shown in the various flowcharts may be implemented by computer instructions (or processor-readable instructions). These computer instructions may be provided to one or more processors to produce a machine, such that execution of the instructions on the processor causes a series of operational steps to be performed to create a means for implementing the embodiments described herein and/or shown in the flowcharts. In some embodiments, these computer instructions may be stored on machine-readable storage media, such as processor-readable non-transitory storage media.

The above specification, examples, and data provide a complete description of the manufacture and use of the composition of the invention. Since many embodiments of the invention can be made without departing from the spirit and scope of the invention, the invention resides in the claims hereinafter appended.

What is claimed is:

1. A method to provide speech enhancement of audio signals from a target source and noise reduction of audio signals from a noise source, comprising:

determining a coherence function between a first audio signal from a first microphone and a second audio signal from a second microphone;

determining a first gain function based on real components of the coherence function;

determining a second gain function based on imaginary components of the coherence function;

determining a third gain function based on a relationship between the real components of the coherence function and a threshold range;

determining a final gain function based on the first gain function, the second gain function, and the third gain function; and generating an enhanced audio signal by applying final gain function to the first audio signal.

2. The method of claim 1, wherein the third gain function is a small constant value when the real component of the coherence function is outside of the threshold range and one when the real component of the coherence function is inside of the threshold range.

3. The method of claim 1, wherein the first gain function, the second gain function, and the third gain function are determined independent of each other.

4. The method of claim 1, wherein the final gain function is a product of the first gain function, the second gain function, and the third gain function raised to a power.

5. The method of claim 1, wherein the first gain function and the second gain function are based on differences between values of the coherence function and values of the coherence function expected for a high signal-to-noise ratio.

6. The method of claim 5, wherein the values of the coherence function expected for a high signal-to-noise ratio are determined using a direct-to-reverberant energy ratio.

7. The method of claim 6, wherein the values of the coherence function expected for a high signal-to-noise ratio are determined further utilizing an angle of incidence of the target source.

8. A network computer to provide speech enhancement of audio signals from a target source and noise reduction of audio signals from a noise source, comprising:

a memory for storing at least instructions; and a processor that executes the instructions to perform actions, including:

determining a coherence function between a first audio signal from a first microphone and a second audio signal from a second microphone;

determining a first gain function based on real components of the coherence function;

determining a second gain function based on imaginary components of the coherence function;

determining a third gain function based on a relationship between the real component of the coherence function and a threshold range;

determining a final gain function based on the first gain function, the second gain function, and the third gain function; and generating an enhanced audio signal by applying the final gain function to the first audio signal.

9. The network computer of claim 8, wherein the third gain function is a small constant value when the real component of the coherence function is outside of the threshold range and one when the real component of the coherence function is inside of the threshold range.

10. The network computer of claim 8, wherein the first gain function, the second gain function, and the third gain function are determined independent of each other.

11. The network computer of claim 8, wherein the final gain function is a product of the first gain function, the second gain function, and the third gain function raised to a power.

12. The network computer of claim 8, wherein the first gain function and the second gain function are based on differences between values of the coherence function and values of the coherence function expected for a high signal-to-noise ratio.

13. The network computer of claim 12, wherein the values of the coherence function expected for a high signal-to-noise ratio are determined using a direct-to-reverberant energy ratio.

14. The network computer of claim 13, wherein the values of the coherence function expected for a high signal-to-noise ratio are determined further utilizing an angle of incidence of the target source.

15. A processor readable non-transitory storage media that includes instructions to provide speech enhancement of audio signals from a target source and noise reduction of audio signals from a noise source, wherein execution of the instructions by a processor performs actions, comprising:

determining a coherence function between a first audio signal from a first microphone and a second audio signal from a second microphone;

determining a first gain function based on real components of the coherence function;

determining a second gain function based on imaginary components of the coherence function;

determining a third gain function based on a relationship between the real component of the coherence function and a threshold range;

determining a final gain function based on the first gain function, the second gain function, and the third gain function; and generating an enhanced audio signal by applying the final gain function to the first audio signal.

16. The media of claim 15, wherein the third gain function is a small constant value when the real component of the coherence function is outside of the threshold range and one when the real component of the coherence function is inside of the threshold range.

17. The media of claim 15, wherein the final gain function is a product of the first gain function, the second gain function, and the third gain function raised to a power.

18. The media of claim 15, wherein the first gain function and the second gain function are based on differences between values of the coherence function and values of the coherence function expected for a high signal-to-noise ratio.

19. The media of claim 18, wherein the values of the coherence function expected for a high signal-to-noise ratio are determined using a direct-to-reverberant energy ratio.

20. The media of claim 19, wherein the values of the coherence function expected for a high signal-to-noise ratio are determined further utilizing an angle of incidence of the target source.

* * * * *